US011787519B2

(12) United States Patent
Rupp

(10) Patent No.: US 11,787,519 B2
(45) Date of Patent: Oct. 17, 2023

(54) UNDERWATER BREATHING DEVICE

(71) Applicant: Zachary William Rupp, Oklahoma City, OK (US)

(72) Inventor: Zachary William Rupp, Oklahoma City, OK (US)

( * ) Notice: Subject to any disclaimer, the term of this patent is extended or adjusted under 35 U.S.C. 154(b) by 218 days.

(21) Appl. No.: 17/475,799

(22) Filed: Sep. 15, 2021

(65) Prior Publication Data

US 2022/0081082 A1 Mar. 17, 2022

Related U.S. Application Data

(60) Provisional application No. 63/079,516, filed on Sep. 17, 2020.

(51) Int. Cl.

| | |
|---|---|
| ***B63C 11/22*** | (2006.01) |
| ***B63C 11/18*** | (2006.01) |
| *B63C 11/24* | (2006.01) |

(52) U.S. Cl.

CPC ..... *B63C 11/22* (2013.01); *B63C 11/186* (2013.01); *B63C 11/2209* (2013.01); *B63C 11/24* (2013.01); *B63C 2011/2218* (2013.01); *B63C 2011/2272* (2013.01); *B63C 2011/2281* (2013.01)

(58) Field of Classification Search

CPC ..... B63C 11/00; B63C 11/02; B63C 11/12; B63C 11/14; B63C 11/16; B63C 11/18; B63C 11/186; B63C 11/20; B63C 11/202; B63C 11/205; B63C 11/22; B63C 11/2209; B63C 11/24; B63C 2011/026; B63C 2011/2272; B63C 2011/2281

See application file for complete search history.

(56) References Cited

U.S. PATENT DOCUMENTS

| | | | | | |
|---|---|---|---|---|---|
| 2,906,263 | A * | 9/1959 | Wolshin | B63C 11/30 | 128/205.18 |
| 5,046,894 | A * | 9/1991 | Bergstrom | B63C 11/02 | 441/106 |
| 5,193,530 | A * | 3/1993 | Gamow | B63C 11/14 | 128/201.27 |
| 5,913,467 | A * | 6/1999 | Berg | A62B 9/04 | 224/628 |
| 5,996,578 | A * | 12/1999 | MacGregor | A62B 9/04 | 128/201.27 |
| 2002/0056455 | A1* | 5/2002 | Vigny | B63C 11/22 | 128/205.22 |
| 2002/0134387 | A1* | 9/2002 | Saurat | B63C 11/22 | 128/205.22 |

(Continued)

FOREIGN PATENT DOCUMENTS

| | | | | |
|---|---|---|---|---|
| DE | 4341910 A1 * | 5/1994 | | B63C 11/22 |
| FR | 2432104 A1 * | 2/1980 | | |
| GB | 2164259 A * | 3/1986 | | B63C 11/202 |

*Primary Examiner* — Colin W Stuart

(74) *Attorney, Agent, or Firm* — Tomlinson Mckinstry, P.C.

(57) ABSTRACT

The present invention provides an underwater breathing device. The device includes a canister having a pump installed therein, wherein air outside of the canister communicates with the interior of the canister via the pump; a mouthpiece; and an elongate tube interconnecting the interior of the canister and the mouthpiece. Methods of making and using the device are also disclosed.

21 Claims, 5 Drawing Sheets

(56) References Cited

U.S. PATENT DOCUMENTS

| | | | | |
|---|---|---|---|---|
| 2010/0270097 | A1* | 10/2010 | Prakash | B60W 20/15<br>477/166 |
| 2013/0333704 | A1* | 12/2013 | Duncan | B63C 11/22<br>128/205.22 |
| 2018/0066759 | A1* | 3/2018 | Case | B63C 11/22 |

* cited by examiner

UNDERWATER BREATHING DEVICE

CROSS-REFERENCE TO RELATED APPLICATION

This application claims the benefit of U.S. provisional application No. 63/079,516, filed Sep. 17, 2020, the teaching of which is incorporated herein by reference in its entirety.

TECHNICAL FIELD OF THE INVENTION

This invention generally relates to a gingival drug delivery system and methods of making and using the same.

BACKGROUND OF THE INVENTION

Background information related to the present disclosure as described herein may not constitute prior art.

Traditional underwater breathing devices known in the art are those used with scuba gear and a snorkel. Scuba gear allows an operator to breath underwater while submerged a distance below the water surface. A snorkel allows an operator to breath underwater while immediately adjacent the water surface.

However, the middle ground between scuba gear and a snorkel is lacking.

Therefore, there is a need for an underwater breathing device between scuba gear and a snorkel.

The embodiments described below address such issues or problems.

SUMMARY OF THE INVENTION

In one aspect of the present invention, it is provided an underwater breathing device, comprising:

- a canister having a pump installed therein, wherein air outside of the canister communicates with the interior of the canister via the pump;
- a mouthpiece; and
- an elongate tube interconnecting the interior of the canister and the mouthpiece.

In some embodiments of the invention device, in combination with any or all the various embodiments disclosed herein, the underwater breathing device further comprises:

- a rigid frame, wherein the canister is attached to the frame; and
- a plurality of straps attached to the frame.

In some embodiments of the invention device, in combination with any or all the various embodiments disclosed herein, the pump comprises a piston disposed within a cylinder, wherein the cylinder is positioned within the interior of the canister.

In some embodiments of the invention device, in combination with any or all the various embodiments disclosed herein, the underwater breathing device further comprises a one-way valve, wherein the one-way valve is installed within the cylinder.

In some embodiments of the invention device, in combination with any or all the various embodiments disclosed herein, the canister further comprises a spring loaded button that forms a barrier between the interior of the canister and the interior of the tube.

In some embodiments of the invention device, in combination with any or all the various embodiments disclosed herein, the canister further comprises a one-way valve, wherein the one-way valve is installed on top of the canister.

In some embodiments of the invention device, in combination with any or all the various embodiments disclosed herein, the canister is made of a plastic material.

In some embodiments of the invention device, in combination with any or all the various embodiments disclosed herein, the canister is made of a metallic material.

In some embodiments of the invention device, in combination with any or all the various embodiments disclosed herein, the canister is made of a ceramic material.

In another aspect of the present invention, it is provided a method of fabrication, comprising

- providing a design of an underwater breathing device that comprises
  - a canister having a pump installed therein, wherein air outside of the canister communicates with the interior of the canister via the pump;
  - a mouthpiece; and
  - an elongate tube interconnecting the interior of the canister and the mouthpiece, and
- forming the underwater breathing device.

In some embodiments of the invention method, in combination with any or all the various embodiments disclosed herein, the underwater breathing device further comprises:

- a rigid frame, wherein the canister is attached to the frame; and
- a plurality of straps attached to the frame.

In some embodiments of the invention method, in combination with any or all the various embodiments disclosed herein, the pump comprises a piston disposed within a cylinder, wherein the cylinder is positioned within the interior of the canister.

In some embodiments of the invention method, in combination with any or all the various embodiments disclosed herein, the underwater breathing device further comprises a one-way valve, wherein the one-way valve is installed within the cylinder.

In some embodiments of the invention method, in combination with any or all the various embodiments disclosed herein, the canister further comprises a spring loaded button that forms a barrier between the interior of the canister and the interior of the tube.

In some embodiments of the invention method, in combination with any or all the various embodiments disclosed herein, the canister further comprises a one-way valve, wherein the one-way valve is installed on top of the canister.

In some embodiments of the invention method, in combination with any or all the various embodiments disclosed herein, the canister is made of a plastic material.

In some embodiments of the invention method, in combination with any or all the various embodiments disclosed herein, the canister is made of a metallic material.

In some embodiments of the invention method, in combination with any or all the various embodiments disclosed herein, the canister is made of a ceramic material.

DETAILED DESCRIPTION OF THE INVENTION

Definitions

As used herein, the term "underwater breathing device" refers to a device that provides air for a user to use underwater to allow the user to stay underwater for a period longer than the user would do underwater without using the device.

Figure 2:
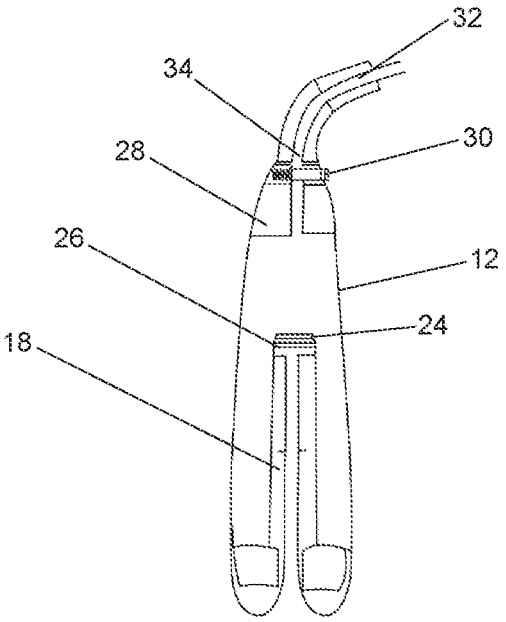
FIG. 2 is a cross-sectional view of a canister used with the underwater breathing device shown in FIG. 1. The piston has been removed from the cylinder.

As used herein, the term "canister" refers to an article capable of holding a volume of air under a pressure that equals to or greater than the ambient pressure. The canister can be made of a metallic material, a ceramic material, a plastic material, or a rubber material, or a mixture thereof. The canister can be rigid or collapsible. An example of the invention canister is shown in FIG. 2.

Underwater Breathing Device

In one aspect of the present invention, it is provided an underwater breathing device, comprising:

- a canister having a pump installed therein, wherein air outside of the canister communicates with the interior of the canister via the pump;
- a mouthpiece; and
- an elongate tube interconnecting the interior of the canister and the mouthpiece.

In some embodiments of the invention device, in combination with any or all the various embodiments disclosed herein, the underwater breathing device further comprises:

- a rigid frame, wherein the canister is attached to the frame; and
- a plurality of straps attached to the frame.

In some embodiments of the invention device, in combination with any or all the various embodiments disclosed herein, the pump comprises a piston disposed within a cylinder, wherein the cylinder is positioned within the interior of the canister.

In some embodiments of the invention device, in combination with any or all the various embodiments disclosed herein, the underwater breathing device further comprises a one-way valve, wherein the one-way valve is installed within the cylinder.

In some embodiments of the invention device, in combination with any or all the various embodiments disclosed herein, the canister further comprises a spring loaded button that forms a barrier between the interior of the canister and the interior of the tube.

In some embodiments of the invention device, in combination with any or all the various embodiments disclosed herein, the canister further comprises a one-way valve, wherein the one-way valve is installed on top of the canister.

In some embodiments of the invention device, in combination with any or all the various embodiments disclosed herein, the canister is made of a plastic material.

In some embodiments of the invention device, in combination with any or all the various embodiments disclosed herein, the canister is made of a metallic material.

In some embodiments of the invention device, in combination with any or all the various embodiments disclosed herein, the canister is made of a ceramic material.

Figure 1:
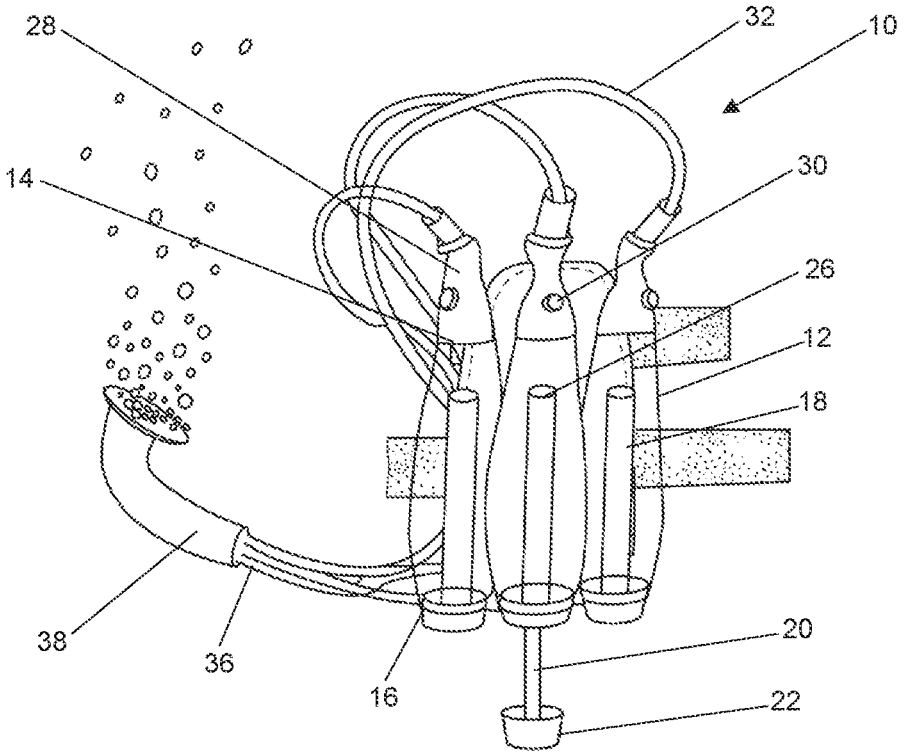
FIG. 1 is a front elevational view of an underwater breathing device.
Figure 3:
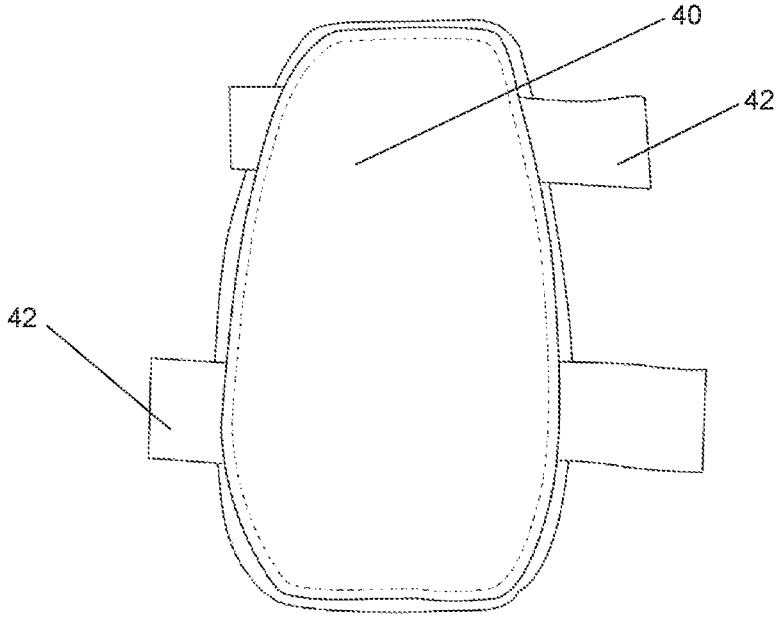
FIG. 3 is a side elevational view of the frame used with the underwater breathing device shown in FIG. 1.

FIGS. 1-3 show an embodiment of an underwater breathing device 10. The device 10 comprises at least one canister 12 having opposed top and bottom ends 14 and 16. The canister 12 is preferably made of plastic, but may be made of any water tight and rust proof material. A cylinder 18 having a reciprocating piston 20 is installed within the interior of the canister 12. The piston 20 projects from the bottom end 16 of the canister 12 and carries a handle 22. A one-way valve 24 is installed within the cylinder 18 approximate its top end 26, as shown in FIG. 2.

Continuing with FIGS. 1 and 2, the canister 12 comprises a connector 28 formed at or attached to its top end 14. The connector 28 houses a spring loaded button 30, shown in FIG. 2. A portion of the button 30 is positioned on the external surface of the connector 28, as shown in FIG. 1. An elongate tube 32 having opposed first end 34 and second end 36 and is installed within the connector 28. The first end 34 of the tube 32 is attached to the spring loaded button 30 within the interior of the connector 28, as shown in FIG. 2. The button 30 forms a barrier between the interior of the canister 12 and the interior of the tube 32. The second end 36 of the tube 32 is attached to a mouthpiece 38, as shown in FIG. 1. The tube 32 and mouthpiece 38 may be made of a flexible plastic or rubble material.

An embodiment of the device 10 shown in FIG. 1 comprises three canisters 12. Each canister 12 is attached to its own tube 32. Each tube 32 is attached to and communicates with the mouthpiece 38. The device 10 may comprise more than three canisters 12 or less than three canisters 12, as desired. The canisters 12 may also vary in size and shape, as desired.

Air may be pumped into each canister 12 individually. Alternatively, the pistons 20 may be connected so that the pistons may be pumped simultaneously. In further alternative embodiments, a small motor may be used to pump air into the canister.

Figure 4:
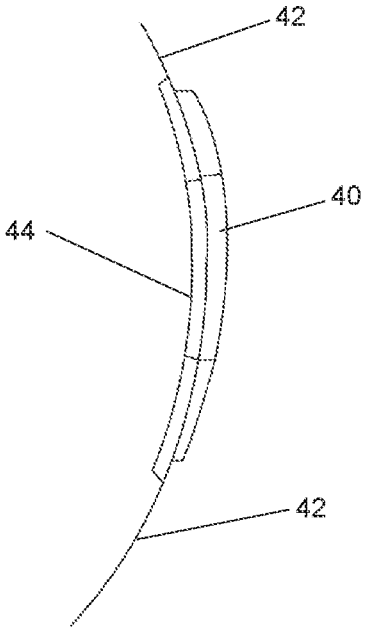
FIG. 4 is a top plan view of the frame shown in FIG. 3.

The canisters 12 may be attached to a frame 40 using a strong and non-water soluble adhesive. Alternatively, the canisters 12 may be attached to the frame 40 using various fasteners known in the art. The frame 12 may be configured to be attached to the operator so that the operator can easily access the mouthpiece 38. For example, the frame 40 may be attached to the operator's arm using a plurality of straps 42, as shown in FIGS. 3 and 4.

The frame 40 may be made of a strong and durable plastic material, strong enough to not fold while pumping the pistons 20 or taking breaths from the mouthpiece 38. Water safe foam 44 may be attached to the back of the frame for comfort, as shown in FIG. 4. The straps 42 may be water safe Velcro straps or other straps configured to withstand an underwater environment.

Figure 5A:
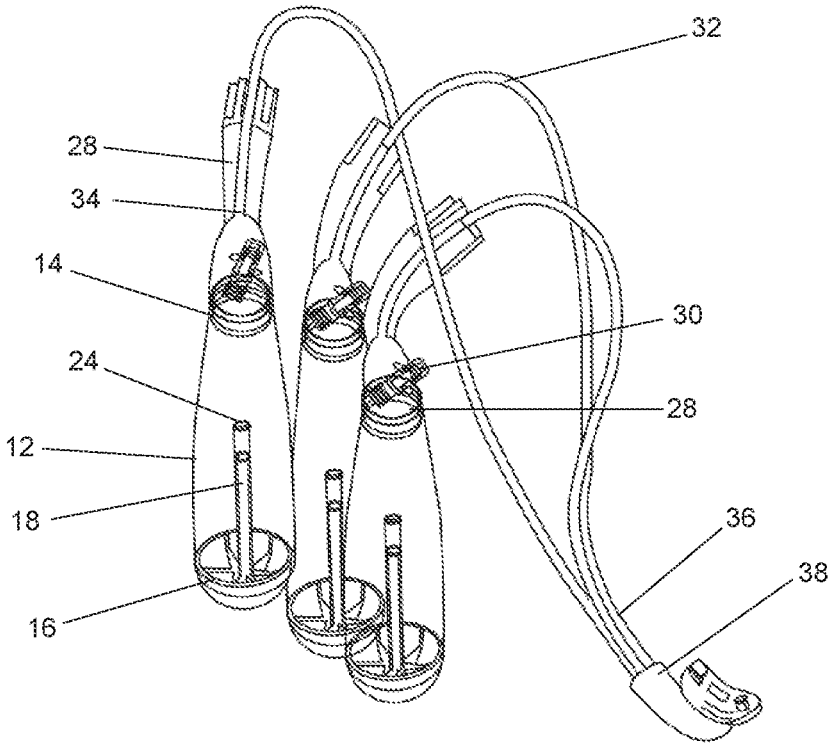
FIGS. 5A-5I show another embodiment of the underwater breathing device of invention.
Figure 5B:
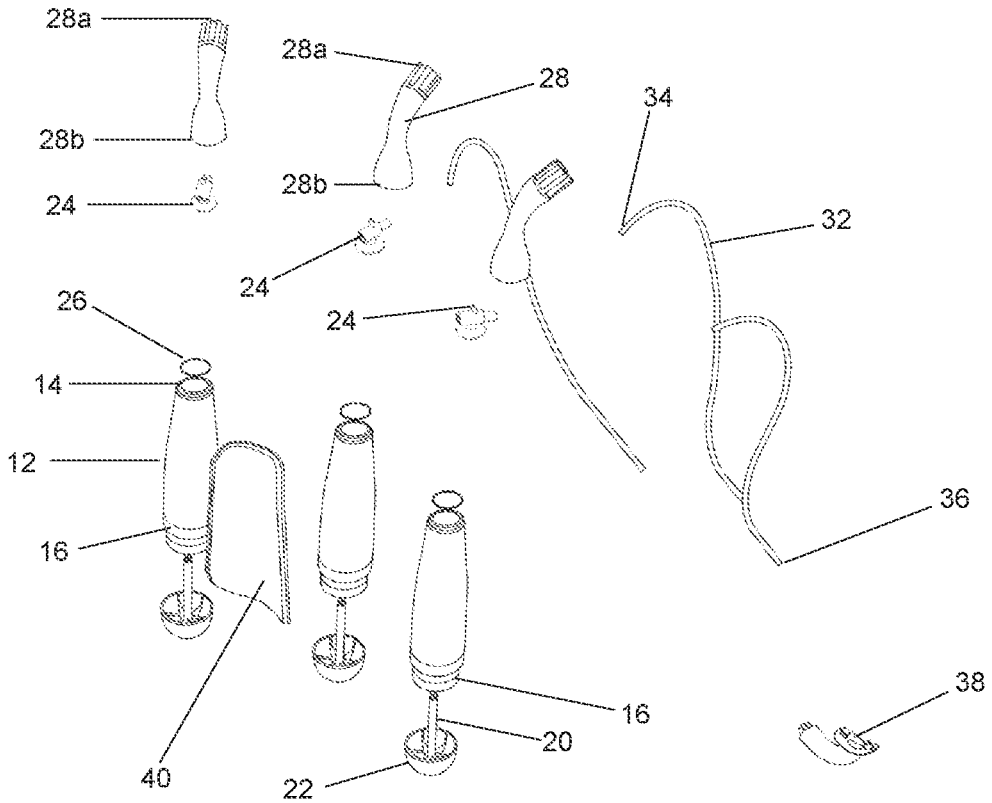
Figure 5C:
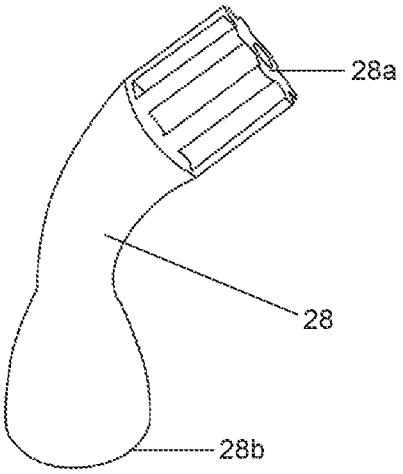
Figure 5D:
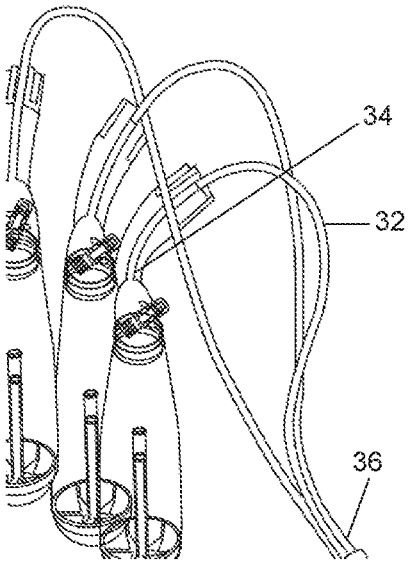
Figure 5E:
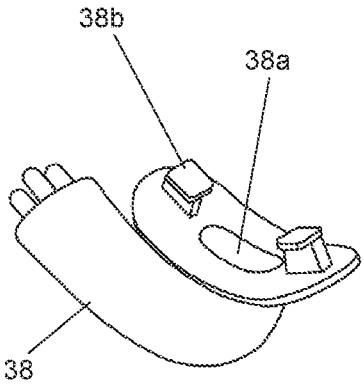
Figure 5F:
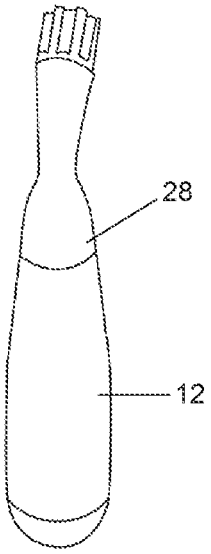
Figure 5G:
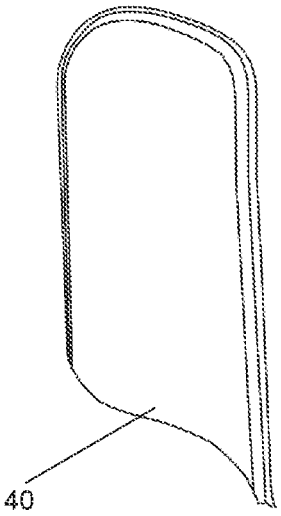
Figure 5H:
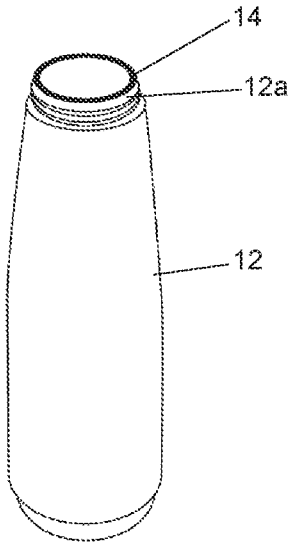
Figure 5I:
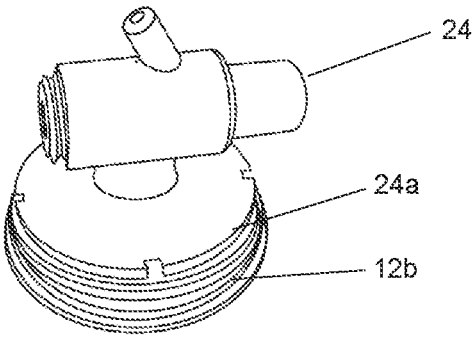

FIGS. 5A-5I show another embodiment of the underwater breathing device 10. In this embodiment, the underwater breathing device 10 has three canisters 12, and the various components (FIGS. 5A-5D, 5F) of device 10 are as shown and described in FIGS. 1-4, with one exception that the one-way valve 24, instead of being installed within the cylinder 18 approximate its top end 26, is installed through a base 24*a* on the top end, 12*a*, of the canister 12 (FIGS. 5H and 5I). The top end 12*a* of canister 12 (FIG. 5H) has a plurality of screw thread configured to engage with the bottom end 28*b* of connector 28 (FIGS. 5B and 5C). FIG. 5C shows connector 28 having a top end 28*a* to receive/connect to tube 32 and bottom end 28*b* configured to attach to the top end 12*a* of canister 12 (FIGS. 5C and 5F).

FIG. 5E shows mouthpiece 38 having a hollow interior 38*a* that is connected to and communicable with elongate tube 32 and two anchor points 38*b* configured to attach to a water seal (not shown) that covers the mouth and nose.

FIG. F shows a canister 12 of the underwater breathing device attached to a connector 28.

A frame 40 is shown in FIG. 5G, which is configured to attach to the device 10 using, e.g., a plurality of straps 42 (now shown).

In some embodiments, various O-ring seals (not shown) can be used to make the device waterproof.

Methods of Fabrication

In another aspect of the present invention, it is provided a method of fabrication, comprising providing a design of an underwater breathing device that comprises a canister having a pump installed therein, wherein air outside of the canister communicates with the interior of the canister via the pump;

a mouthpiece; and an elongate tube interconnecting the interior of the canister and the mouthpiece, and forming the underwater breathing device.

In some embodiments of the invention method, in combination with any or all the various embodiments disclosed herein, the underwater breathing device further comprises:

a rigid frame, wherein the canister is attached to the frame; and a plurality of straps attached to the frame.

In some embodiments of the invention method, in combination with any or all the various embodiments disclosed herein, the pump comprises a piston disposed within a cylinder, wherein the cylinder is positioned within the interior of the canister.

In some embodiments of the invention method, in combination with any or all the various embodiments disclosed herein, the underwater breathing device further comprises a one-way valve, wherein the one-way valve is installed within the cylinder.

In some embodiments of the invention method, in combination with any or all the various embodiments disclosed herein, the canister further comprises a spring loaded button that forms a barrier between the interior of the canister and the interior of the tube.

In some embodiments of the invention method, in combination with any or all the various embodiments disclosed herein, the canister further comprises a one-way valve, wherein the one-way valve is installed on top of the canister.

In some embodiments of the invention method, in combination with any or all the various embodiments disclosed herein, the canister is made of a plastic material.

In some embodiments of the invention method, in combination with any or all the various embodiments disclosed herein, the canister is made of a metallic material.

In some embodiments of the invention method, in combination with any or all the various embodiments disclosed herein, the canister is made of a ceramic material.

Materials

The underwater breathing device can be made of any material capable of withstanding a degree of pressure underwater. Such a material can be metallic, ceramic, glass, clay, or plastic, rubber, or resins, or a combination thereof. Components of the device can be formed from the same material or different material. A preferred material is a plastic material.

Components of the device disclosed herein can be formed by known methods. Such methods can be, for example, casting, molding, hot blowing, hot pressing, 3D-printing, or another method known in the art.

Method of Use

Method of use of the underwater breathing device disclosed herein is described in reference to FIGS. 1-4 and 5A-5I. Briefly, in operation, prior to submerging under water, an operator may manually reciprocate the piston 20 within the cylinder 18 in order to pump air through the one-way valve 24 and into the interior of the canister 12. Once underwater, the operator may insert the mouthpiece 38 into his mouth and press the button 30. When the button 30 is pressed, the portion of the button within the interior of the connector 28 moves so as to no longer form a barrier between the interior of the canister 12 and the interior of the tube 32. After pressing the button 30, the operator inhales into the mouthpiece 38, causing air to flow from the canister 12, through the tube 32, and into the mouthpiece 38.

Carbon Dioxide Absorbent

In some embodiments of the invention device, the device can be made a closed system, which can include a carbon-dioxide (CO2) absorbent. In some embodiments, the CO2 absorbent can be a chemical agent that is capable of react with CO2 exhaled from a user to make an inert chemical such that the CO2 level in the gas of a closed system is reduced or kept constant.

Examples of such CO2 absorbent are basic materials such as an alkaline or earth metal hydroxide, e.g., LiOH, NaOH, KOH, CsOH, $Ca(OH)_2$, $Mg(OH)_2$, $Ba(OH)_2$, a carbonate, e.g., $Na_2CO_3$, $K_2CO_3$, or an element metal, e.g., Mg.

In some embodiments, the CO2 absorbent can be a polymeric material that absorbs or immobilize CO2, e.g., a polymer of having basic groups such as a polyamine resin or Polyvinylpyrrolidone—PVP.

EXAMPLES

An example of the underwater breathing device was designed and can be fabricated according to FIGS. 5A-5I, described above.

While the present invention has been described in terms of preferred embodiments, it will be appreciated by one of ordinary skill that the spirit and scope of the invention is not limited to those embodiments, but extend to the various modifications and equivalents as defined in the appended claims.

Further, changes may be made in the construction, operation and arrangement of the various parts, elements, steps and procedures described herein without departing from the spirit and scope of the invention as described in the following claims.

I claim:

1. An underwater breathing device, comprising:

a canister having a pump installed therein, wherein air outside of the canister communicates with an interior of the canister via the pump;

a mouthpiece; and an elongate tube interconnecting the interior of the canister and the mouthpiece;

wherein the canister comprises a spring loaded button that forms a barrier between the interior of the canister and an interior of the tube.

2. The underwater breathing device of claim 1, further comprising:

a rigid frame, wherein the canister is attached to the frame; and a plurality of straps attached to the frame.

3. The underwater breathing device of claim 1, wherein the pump comprises a piston disposed within a cylinder, wherein the cylinder is positioned within the interior of the canister.

4. The underwater breathing device of claim 3, further comprising a one-way valve, wherein the one-way valve is installed within the cylinder.

5. The underwater breathing device according to claim 1, further comprising a one-way valve, wherein the one-way valve is installed on top of the canister.

6. The underwater breathing device according to claim 1, wherein the canister is made of a plastic material.

7. The underwater breathing device according to claim 1, wherein the canister is made of a metallic material.

8. The underwater breathing device according to claim 1, wherein the canister is made of a ceramic material.

9. A method of fabrication, comprising:

providing a design of an underwater breathing device that comprises:

a canister having a pump installed therein, wherein air outside of the canister communicates with an interior of the canister via the pump;

a mouthpiece; and an elongate tube interconnecting the interior of the canister and the mouthpiece;

wherein the canister further comprises a spring loaded button that forms a barrier between the interior of the canister and an interior of the tube; and forming the underwater breathing device.

10. The method according to claim 9, wherein the underwater breathing device further comprises:

a rigid frame, wherein the canister is attached to the frame; and a plurality of straps attached to the frame.

11. The method according to claim 9, wherein the pump comprises a piston disposed within a cylinder, wherein the cylinder is positioned within the interior of the canister.

12. The method according to claim 11, further comprising a one-way valve, wherein the one-way valve is installed within the cylinder.

13. The method according to claim 9, wherein the underwater breathing device further comprises a one-way valve, wherein the one-way valve is installed on top of the canister.

14. The method according to claim 9, wherein the canister is made of a plastic material.

15. The method according to claim 9, wherein the canister is made of a metallic material.

16. The method according to claim 9, the canister is made of a ceramic material.

17. An underwater breathing device, comprising:

a canister having opposed top and bottom ends;

a pump, wherein at least a portion of the pump is installed within an interior of the canister, wherein air outside of the canister communicates with the interior of the canister via the pump;

a connector attached to the top end of the canister;

a one-way valve installed within the connector;

a mouthpiece; and an elongate tube interconnecting the one-way valve and the mouthpiece wherein the one-way valve forms a barrier between the interior of the canister and an interior of the tube.

18. The underwater breathing device of claim 17, wherein the one-way valve comprises a spring loaded button.

19. The underwater breathing device of claim 17, wherein the one-way valve is supported on a base sized to cover the top end of the canister.

20. An apparatus, comprising:

a first underwater breathing device supported on a wearable frame and comprising:

a first canister having opposed top and bottom ends;

a first pump, wherein at least a portion of the first pump is installed within an interior of the first canister, wherein air outside of the first canister communicates with the interior of the first canister via the first pump;

a first connector attached to the top end of the first canister;

a first one-way valve installed within the first connector;

a first elongate tube installed within the first connector and attached to the first one-way valve; wherein the first one-way valve forms a barrier between the interior of the first canister and an interior of the first tube;

a second underwater breathing device supported on the wearable frame in a side-by-side relationship with the first underwater breathing device, the second underwater breathing device comprising:

a second canister having opposed top and bottom ends;

a second pump, wherein at least a portion of the second pump is installed within an interior of the second canister, wherein air outside of the second canister communicates with the interior of the second canister via the second pump;

a second connector attached to the top end of the second canister;

a second one-way valve installed within the second connector;

a second elongate tube installed within the second connector and attached to the second one-way valve; wherein the second one-way valve forms a barrier between the interior of the second canister and an interior of the second tube; and a mouthpiece attached to an end of the first tube and an end of the second tube.

21. An apparatus, comprising:

a first underwater breathing device supported on a wearable frame, the first underwater breathing device comprising:

a first canister having a first pump installed therein, wherein air outside of the first canister communicates with an interior of the first canister via the first pump; and a first elongate tube, at least a portion of the first elongate tube installed within the first canister; and a first one-way valve installed within a first connector and forming a barrier between the interior of the first canister and an interior of the first tube;

a second underwater breathing device supported on the wearable frame in a side-by-side relationship with the first underwater breathing device, the second underwater breathing device comprising:

a second canister having a second pump installed therein, wherein air outside of the second canister communicates with an interior of the second canister via the second pump; and a second elongate tube, at least a portion of the second elongate tube installed within the second canister; and a second one-way valve installed within a second connector and forming a barrier between the interior of the second canister and an interior of the second tube; and a mouthpiece attached to an end of the first tube and an end of the second tube.

* * * * *